United States Patent [19]

Masek et al.

[11] 4,121,617

[45] Oct. 24, 1978

[54] COMBINED STOP AND CONTROL VALVE

[75] Inventors: Jaroslav Masek, Wettingen; Arthur Oberle, Ennetbaden, both of Switzerland

[73] Assignee: BBC Brown, Boveri & Company Limited, Baden, Switzerland

[21] Appl. No.: 676,409

[22] Filed: Apr. 13, 1976

[30] Foreign Application Priority Data

Apr. 30, 1975 [CH] Switzerland ..... 5562/75

[51] Int. Cl.[2] ..... F16K 1/00

[52] U.S. Cl. ..... 137/630.14; 137/613; 137/630.15

[58] Field of Search ..... 137/613, 625.3, 630.14, 137/630.15, 637.2

[56] References Cited

U.S. PATENT DOCUMENTS

| | | | |
|---|---|---|---|
| 3,602,261 | 8/1971 | Brown et al. | 137/625.3 |
| 3,809,126 | 5/1974 | Oberle | 137/613 X |

*Primary Examiner*—Alan Cohan
*Assistant Examiner*—Richard Gerard
*Attorney, Agent, or Firm*—Burns, Doane, Swecker & Mathis

[57] ABSTRACT

A combined stop and control valve for incorporation into a pipe carrying the working medium of a turbomachine and in particular a steam turbine has the respective bodies of the stop and control valves arranged independently of each other in a common housing which is provided with co-axially arranged valve seats located adjacent one another at the flow opening of the valve cage. The body of the control valve has a bell-shaped configuration into the hollow cavity of which the body of the stop valve travels co-axially, and both of the valve bodies are rigidly supported in their end positions against the valve housing. The valve seat is provided with a throttle collar around which circumferentially spaced slots are distributed, the inner diameter of the collar being approximately equal to that of the control edge of the control valve body. The body of the stop valve has a conical seating surface which together with the inner circumference of the control valve body forms an annular gap tapering in the flow direction of the working medium.

2 Claims, 2 Drawing Figures

COMBINED STOP AND CONTROL VALVE

Figure 1:
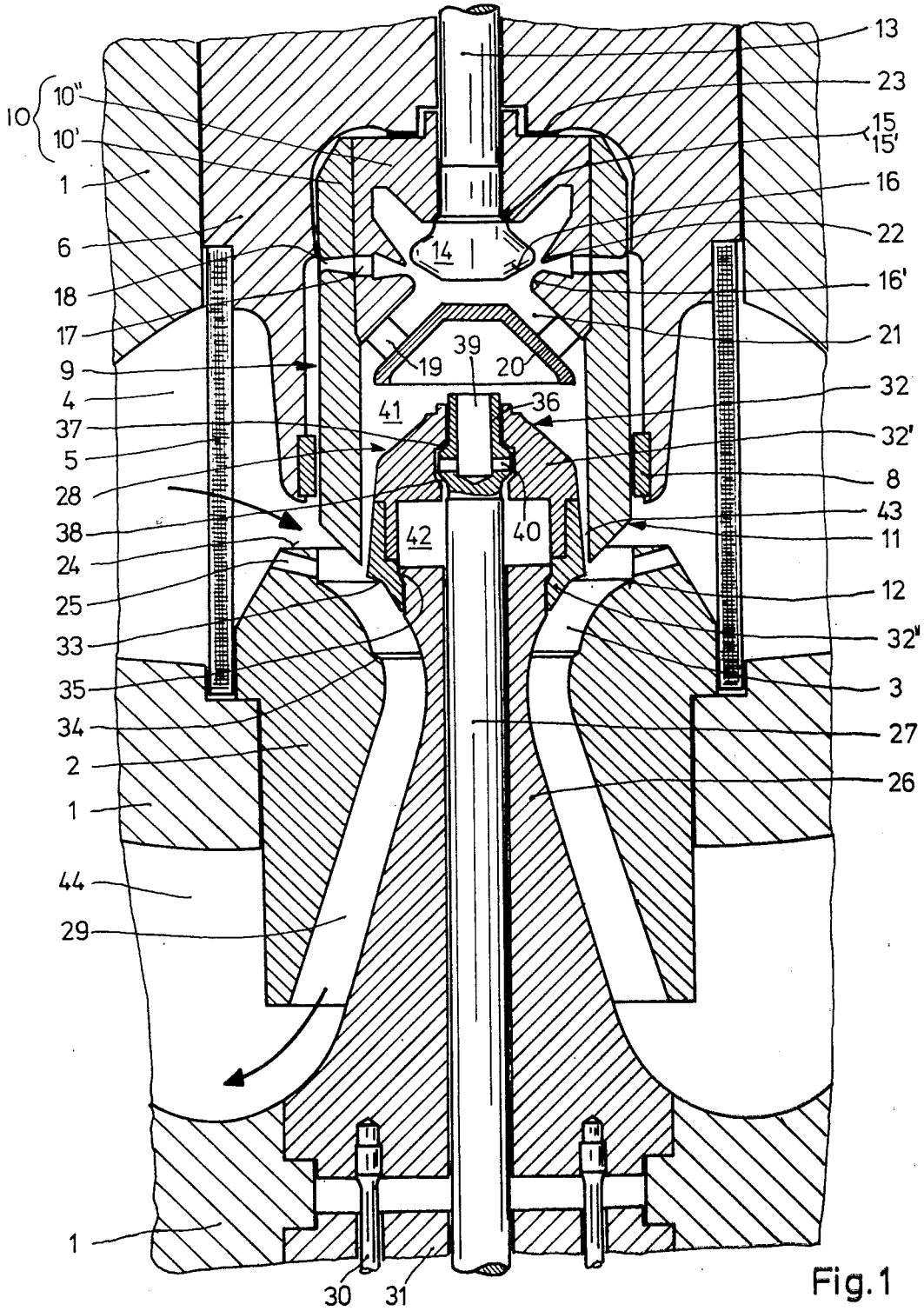

This invention relates to an improved construction for a combined stop and control valve for mounting in pipes carrying the working medium of turbo-machines, in particular steam turbines, of which the stop valve body and control valve body are arranged independently of each other in a common valve housing and are provided with coaxial valve seats located next to each other and immediately at a flow opening of the valve cage, the body of the control valve being in the form of a bell into the hollow cavity of which the stop valve body travels coaxially and both the control valve body and the stop valve body are rigidly supported in their end positions against the valve housing.

In general, the pipes carrying the working medium of turbo-machines, particularly in the case of gas and steam turbines, incorporate control and stop valves which are contained in separate housings. Since the location of several such housings requires a relatively large amount of space, proposals have already been made for combined stop and control valves in a common valve housing. This valve construction of the kind mentioned above also has the advantage of reduced flow resistance, owing to the common valve seat.

During the course of the development of power plant construction, in view of the ever greater flow volumes this valve unit came to be used both as a control valve in the live steam line and as an interceptor valve in the reheat lines. The control valve body then serves either to adapt the output of the turbine to the different power requirements, or to protect the turbine from accelerating in the overspeed range following load rejection brought about by external factors or in the event of an operational rapid shutdown.

It has been found, however, that this kind of combined control and stop valve unit has a tendency to vibrate when the turbine is operating in the part-load range, i.e., when the valve is partially opened, and also in various ranges of pressure difference.

The general object of the invention is therefore, on the one hand, to avoid this vibration in a combined control and stop valve, and on the other, to provide adequate assurance that the turbine installation can be controlled over the whole operating range.

This object is achieved in that the valve seat is provided with a throttle collar around the circumference of which slots are distributed whose inner diameter is at least approximately equal to that of the control edge of the control valve body, the body of the stop valve having a conical outer contour which together with the inner circumference of the control valve body forms an annular gap tapering in the flow direction of the working medium.

In a preferred embodiment of the invention the control valve body is provided in known manner with a pilot valve, the flow aperture of which is screened from the stop valve body with a hood, the hood being attached by means of struts to the control valve body.

According to a further feature the flow of working medium approaching the pilot valve in the control valve body is provided with ejector nozzles.

The advantages of the invention lie generally in the fact that the crown shape of the valve seat and the conical shape of the control edge reduce the forces which stimulate vibration, and the flow noise of the working medium at the flow aperture of the valve in part-load operation is almost completely eliminated. Owing to the smaller excitation forces, the cyclic stress on the components of the control and stop valves and their spindles are lessened, and hence reliability is substantially improved.

These measures are aided by the hood inside the control valve body which, in conjunction with the conical outer contour of the stop valve, exerts an aerodynamic centering action on the two valve bodies.

In addition, the ejector nozzles in the control valve body have the effect of reducing the pressure in the space above the control valve body. This relieves the shear loading on the control valve body when the pilot valve is open. That is to say, when pilot valve 14 has begun to open, the suction effect of the ejector nozzles 17 reduces the pressure in the space above the control valve (the pilot valve seat 15 is not yet closed at that moment), and hence also the axial force required for lifting the control valve is reduced.

Figure 2:
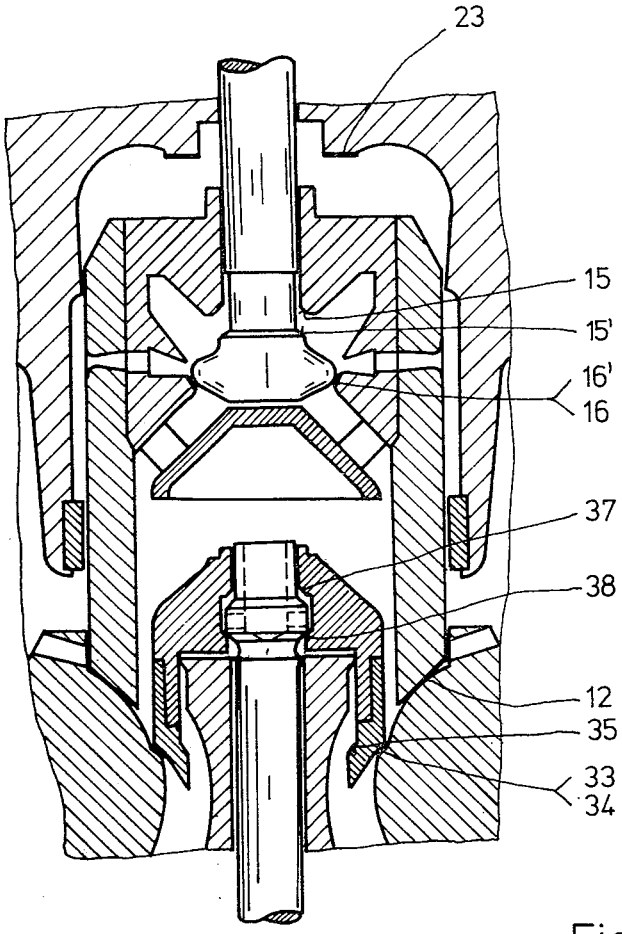

The invention is explained in the following by means of a preferred embodiment with reference to the accompanying drawings, in which:

FIG. 1 shows an axial section of a combined control and stop valve for a steam turbine installation with the valve in the open position, and FIG. 2 shows the section corresponding to FIG. 1 with the valve in the closed position.

In the figures the same reference symbols are used for corresponding parts.

In FIG. 1 only the housing 1 of the valve is indicated, i.e., only parts adjacent to the flow aperture 3 and the valve seat 2 are shown. The flow of working medium enters by way of the inlet volute 4. The control valve 9 is surrounded by a stream strainer 5 which is rigidly fixed at one end between the housing 1 and the valve seat 2, and at the other end between the latter and the housing cover 6.

Fixed to the housing cover 6 is a cylindrical guide bush 8 which acts as a guide for the control valve 9. The latter comprises the two-part control valve body 10, the sleeve portion 10' of which incorporates a control edge 11 for the seating surface 12 on valve seat 2. The inner base portion 10'' accommodates the pilot valve 14, which is mounted on spindle 13. The pilot valve 14 has two seats 15 and 16 which correspond to seats 15' and 16', respectively, on the base portion 10''. Located in the sleeve portion 10' are ejector-type nozzles 18 which communicate with the holes 17 in base portion 10''. The hood 20 is fixed to the base portion 10'' by way of struts 19. The hood forms an annular gap 21 between sleeve portion 10' and the edge of the hood.

In the fully open position illustrated, the control valve 9 is held against axial movement by means of spindle 13 in that the pilot valve 14 rests on seat 15 and the control valve body 10 bears on seat 23.

Outside the seating surface 12 on valve seat 2 there is a throttle collar 24, the edge of which is interrupted by individual slots or grooves 25. The control edge 11 of control valve 9 is formed by the transition of the cylindrical outer contour of the sleeve 10' to the conical seating surface. When the valve is fully open, this conical seating surface, together with the conical seat portion 33 of the stop valve and the outer surface of the guide bush 26, forms an aerodynamically favourable inner bounding surface in the inlet section to the annular diffusor 29.

For reasons of assembly, the guide bush 26 of spindle 27 of the stop valve 28 is in two parts; the lower part is fixed in housing 1 to the housing cover 31 by means of bolts 30. Bearing components and glands, not described in more detail, are provided in the housing covers 6 and 31 for the spindles 13 and 27 of the control and stop valves 9 and 28, respectively.

The stop valve 28 consists of the valve body 32, the seat portion 33 of which corresponds with the seating surface 34 on valve seat 2. For reasons of design, the valve body 32 is in two pieces, the sleeve-shaped portion 32'' of which has on one side a seat 35 for maintaining the stop valve 28 in the open position, and on the other side has a conical seat portion 33 on its outer circumference. The main piece 32' of the valve body, on the other hand, accommodates the pilot valve 36 with the two seats 27 and 38, one of which must at any given time be disengaged or open.

The spindle 27 of the stop valve 28 is provided with a drilled hole 39 having channels 40 which when the stop valve 28 is open, but also as soon as the pilot valve 36 opens, create a fluid connection between the space 41 inside the control valve body 10 and the space 42 enclosed by the body 32 of the stop valve. The channels 40 terminate at the outer circumference of the spindle between the seats 37 and 38 of the pilot valve 36.

In FIG. 2 the two valves 9 and 28 are shown in the closed position, enabling the concentric location of the two valve seats 12 and 34 to be clearly seen.

The operating principle of the combined control and stop valve will now be described with reference to the two figures.

When the combined valve opens normally, first the stop valve 28 is opened, i.e., the spindle 27 is moved upwards and disengages the seat 38 of the pilot valve 36. When the pilot valve 36 engages seat 37, the stop valve body 32 is raised further until the seat 35 bears on the corresponding part of the guide bush 26. The stop valve 28 has then reached the full extent of its travel and is statically located in position.

The control valve 9, which up to this time has been closed, can now also be opened. For this, the spindle 13 is moved and the pilot valve 14 disengaged from seat 16'. The working medium, which has been able to pass through the nozzles 18 into the space above the valve seat 16' in the valve body 10, can now flow into space 41. When the pilot valve is open, the jets from the nozzles 18 create a zone of reduced pressure at the gap between pilot valve 14 and edge 22 which exerts a suction effect on the space over the control valve. The pressure in this space is thus reduced. As soon as the pilot valve 14 bears on seat 15, the control valve body 10 disengages from valve seat 12 and the working medium can flow via the throttle collar 24 and slot 25 into the annular diffusor 29, and leave the valve housing through the outlet volute 44. At flow rates pertaining to partial valve travel, i.e. at flow rates delivered when the valve is in a position intermediate its closed and fully open positions, respectively, the flow at the throttle collar 24 is divided into a number of streams, each of which individually follows more closely the contour of the annular diffusor 29. In this way the guide bush 26 and the stop valve 28 are not induced to vibrate either by direct flow impingement or by possible flow separation in the annular diffusor 29.

The pilot valve flow of working medium passing through the nozzles 18 and annular gap 21 also has a stabilizing effect on the stop valve 28, in particular because a steady flow can be achieved in the gap 43 remaining between the inside wall of the control valve body 10' and the outer circumference of the sleeve portion 32'' of the valve body 32. For this purpose the stop valve body including the sleeve portion 32'' is provided in the vicinity of the seat portion 33 with a conical surface which tapers the annular gap 43 in the flow direction. The nozzle thus formed brings about an aerodynamically centering effect.

We claim:

1. In a combined stop and control valve for mounting in a pipe carrying a working medium of a turbo machine, in particular a steam turbine machine, having a stop valve body and a control valve body which are arranged independently of each other in a common valve housing and having coaxial valve seats provided in a valve seat body and located next to each other, the coaxial valve seats being provided immediately at a flow opening of the valve seat body, the control valve body being in the form of a bell having a hollow cavity, the stop valve body being slidable coaxially into the hollow cavity, both the control valve body and the stop valve body being rigidly supported when in their respective end positions against the valve housing, the valve seat body being provided with a throttle collar having slots distributed around the circumference of the throttle collar, an inner diameter of the throttle collar being approximately equal to the inner diameter of a circle formed by a control edge of the control valve body, the improvement wherein ejector nozzles are provided around the circumference of the control valve body providing communication between the interior of the control valve body and upstream working medium pressure, the nozzles discharging above a seat of a pilot valve provided in the control valve body to induce a pressure drop in a space in the housing above the control valve body, said space receiving the control valve body in the open position thereof and having communication with the interior of the control valve body on initial opening of the pilot valve whereby the force required for actuating the control valve is reduced.

2. The combined control and stop valve of claim 1 wherein the improvement further comprises the stop valve body having a conically shaped annular portion having a seat portion formed thereon, the annular portion together with the inner circumference of the control valve body forming an annular gap tapering in the direction of flow of the working medium, the working medium flowing from the ejector nozzles through the annular gap thereby causing a stabilizing effect on the stop valve body.

* * * * *